US010038240B2

(12) United States Patent
Patron et al.

(10) Patent No.: US 10,038,240 B2
(45) Date of Patent: Jul. 31, 2018

(54) WIDE BAND RECONFIGURABLE PLANAR ANTENNA WITH OMNIDIRECTIONAL AND DIRECTIONAL RADIATION PATTERNS

(71) Applicants: Drexel University, Philadelphia, PA (US); Adant Technologies, Inc., Santa Clara, CA (US)

(72) Inventors: Damiano Patron, Philadelphia, PA (US); Kapil R. Dandekar, Philadelphia, PA (US); Daniele Piazza, Lodi (IT)

(73) Assignees: Drexel University, Philadelphia, PA (US); Adant Technologies, Inc., Santa Clara, CA (US)

( * ) Notice: Subject to any disclaimer, the term of this patent is extended or adjusted under 35 U.S.C. 154(b) by 0 days.

(21) Appl. No.: 14/653,076

(22) PCT Filed: Dec. 20, 2013

(86) PCT No.: PCT/US2013/076816
§ 371 (c)(1),
(2) Date: Jun. 17, 2015

(87) PCT Pub. No.: WO2014/143320
PCT Pub. Date: Sep. 18, 2014

(65) Prior Publication Data

US 2015/0349418 A1 Dec. 3, 2015

Related U.S. Application Data

(60) Provisional application No. 61/740,913, filed on Dec. 21, 2012.

(51) Int. Cl.
*H01Q 3/24* (2006.01)
*H01Q 9/44* (2006.01)
(Continued)

(52) U.S. Cl.
CPC ..... *H01Q 3/24* (2013.01); *H01Q 1/38* (2013.01); *H01Q 3/44* (2013.01); *H01Q 9/44* (2013.01); *H01Q 21/205* (2013.01); *H01Q 21/30* (2013.01)

(58) Field of Classification Search
CPC ..... H01Q 3/24; H01Q 9/44; H01Q 21/00
(Continued)

(56) References Cited

U.S. PATENT DOCUMENTS 4,072,951 A 2/1978 Kaloi
6,356,242 B1 * 3/2002 Ploussios ..... H01Q 9/42 343/795

(Continued)

OTHER PUBLICATIONS

Facco, et al., "Reconfigurable Zero-Order Loop Antenna", IEEE, Jul. 2012, pp. 1-2.

(Continued)

*Primary Examiner* — Dameon E Levi
*Assistant Examiner* — Hasan Islam
(74) *Attorney, Agent, or Firm* — Baker & Hostetler LLP

(57) ABSTRACT

A planar reconfigurable antenna that is capable of generating omnidirectional and directional radiation patterns over a wide frequency band or over multiple frequency bands includes a substrate, one or more pairs of conductive elements on at least one side of the substrate, a common RF feed point, and respective switches that selectively connects one or all of the conductive elements to the common RF feed point. An omni-directional radiation pattern is generated when all of the conductive elements are connected to the common RF feed point, while a directional radiation pattern is generated when only a pair of conductive elements on opposite sides of the substrate are connected to the common RF feed point. In the directional radiation mode, the conductive elements that are not connected to the common RF feed point act as a reflector for other conductive elements that are connected to the common RF feed point.

18 Claims, 7 Drawing Sheets

(51) Int. Cl.

| | |
|---|---|
| ***H01Q 1/38*** | (2006.01) |
| ***H01Q 3/44*** | (2006.01) |
| ***H01Q 21/20*** | (2006.01) |
| ***H01Q 21/30*** | (2006.01) |

(58) Field of Classification Search
USPC ..... 343/833–835, 876, 893, 853
See application file for complete search history.

(56) References Cited

U.S. PATENT DOCUMENTS

| | | | | |
|---|---|---|---|---|
| 6,459,415 | B1 | 10/2002 | Pachal et al. | |
| 6,483,462 | B2 | 11/2002 | Weinerberger | |
| 7,079,079 | B2 * | 7/2006 | Jo | H01Q 1/243 343/700 MS |
| 7,589,674 | B2 | 9/2009 | Anagnostou et al. | |
| 7,652,632 | B2 | 1/2010 | Shtrom | |
| 2010/0103066 | A1 * | 4/2010 | Shtrom | H01Q 3/24 343/834 |
| 2011/0074653 | A1 * | 3/2011 | Shtrom | H01Q 1/241 343/893 |

OTHER PUBLICATIONS

Liao, et al., "A Compact Planar Multiband Antenna for Integrated Mobile Devices", Progress in Electromagnetic Research, 2010, vol. 109, 1-16.

* cited by examiner

WIDE BAND RECONFIGURABLE PLANAR ANTENNA WITH OMNIDIRECTIONAL AND DIRECTIONAL RADIATION PATTERNS

CROSS-REFERENCE TO RELATED APPLICATIONS

This application is the National Stage of International Application No. PCT/US2013/076816 filed Dec. 20, 2013, which claims the benefit of and priority to U.S. Provisional Application No. 61/740,913, filed Dec. 21, 2012, the entireties of which applications are incorporated herein by reference for any and all purposes.

GOVERNMENT RIGHTS

The subject matter disclosed herein was made with government support under award/contract/grant number CNS-0916480 awarded by the National Science Foundation. The Government has certain rights in the herein disclosed subject matter.

TECHNICAL FIELD

The invention is in the field of reconfigurable antennas. In particular, the invention includes an antenna structure capable of generating omnidirectional and directional radiation patterns. An implementation of the antenna structure includes an antenna design that allows switching among four directional patterns and a single omnidirectional mode over a single wide frequency bandwidth or multiple frequencies. The antenna is suitable for small devices due to its compact planar design.

BACKGROUND

Current antenna systems can be divided into three main categories: i) antennas which radiate with a fixed pattern and polarization ("standard antennas"); ii) antennas including a matrix of active elements that radiates with variable patterns and/or polarizations by conveniently phasing each active element ("phased array"); and iii) antennas including a single active element showing a different pattern and polarization depending on the adopted current distribution on the radiating element ("reconfigurable antennas").

These two classes of adaptive antennas (phased arrays and reconfigurable antennas) have received strong attention in the last several years with respect to standard antennas due to their capability of dynamically changing the radiation properties of the antenna in response to the multivariate behavior of the wireless channel. The reconfigurable antenna solution is then preferable with respect to a phased array antenna mainly because i) it employs a single active element and therefore it occupies a small space and ii) it allows for high radiation efficiency since it does not employ phase shifters and power dividers.

Different types of reconfigurable antennas capable of changing pattern and polarization have been proposed in the art. These antennas may employ embedded switches or variable capacitors to change the current distribution on the metallization of the active element, or may employ an active antenna element surrounded by passive elements (parasitic elements) loaded with variable capacitors or connected to switches.

However, none of the prior art approaches allows radiating with omnidirectional and directional radiation patterns while preserving a planar design (e.g., two layer printed circuit board). To the inventors' knowledge, the only antenna technology capable of achieving this type of reconfigurability is the one described by M. Facco and D. Piazza, in "Reconfigurable Zero-Order Loop Antenna," IEEE International Symposium on Antennas and Propagation and USNC/URSI, 2012. However, the metamaterial active element of such design along with the surrounded reactive components results in a narrow frequency bandwidth. The invention described herein allows designs of planar reconfigurable antennas capable of generating omnidirectional and directional radiation patterns over a wide frequency band or over multiple bands.

SUMMARY

The invention addresses the above-mentioned needs in the art by providing a planar reconfigurable antenna that is capable of generating omnidirectional and directional radiation patterns over a wide frequency band or over multiple frequency bands. In exemplary embodiments, such an antenna includes a substrate, a plurality of conductive elements on at least one side of the substrate, a common RF feed point, and respective switches that selectively connect all or some of the conductive elements to the common RF feed point. In a first mode, all of the conductive elements are connected to the common RF feed point for generation of an omnidirectional radiation pattern, while in a second mode, a pair of conductive elements on opposite sides of the substrate are connected to the common RF feed point for generation of a directional radiation pattern. Each of the conductive elements may be a wideband or multiband radiating element. Also, the conductive elements that are not connected to the common RF feed point act as a reflector for other conductive elements that are connected to the common RF feed point in the direction radiation mode.

In exemplary embodiments, the conductive elements are arranged on the substrate such that when all of the conductive elements are directly connected to the common RF feed point, the current distribution is uniform and it generates the omnidirectional radiation pattern in an azimuth plane. Also, in the exemplary embodiments, the conductive elements are placed symmetrically on the substrate with respect to the common RF feed point at a center of the antenna and at a relative distance with respect to other conductive elements which is less than one quarter of a wavelength of the antenna in free space.

In other exemplary embodiments, the plurality of conductive elements include four folded metallic elements on each side of the substrate, and pairs of the conductive elements on opposite sides of the substrate form four pairs of branches that are disposed 90 degrees with respect to each other and are connected to the common RF feed point via a pin diode or any other RF switching device that allows one to connect/disconnect metallic elements. Also, in other exemplary embodiments the planar antenna may or may not have additional parasitic elements placed on the top or bottom layer. These parasitic elements can be placed around the main 90° elements, acting as enhancement for directivity and gain of the beams. In essence, the parasitic elements act as directors and/or reflectors during directional modes of operation, enhancing front-to-back ratio and gain of the radiation patterns. Even when an omnidirectional beam is generated, the gain is appreciably improved.

The conductive elements may also have different shapes and sizes. For example, each of the conductive elements may be in the form of a wing having a first section that is connected to the common RF feed port and a second section that is substantially perpendicular to the first section. The second section may or may not have a slot depending upon whether a single wide bandwidth or dual band behavior is desired. Also, the second section may form a double wing structure whereby the second section and the first section together form an "F" shape to resonate over multiple frequencies. Alternatively, the second section may form a tapered wing structure to permit the antenna to resonate over a wide bandwidth.

The conductive elements may also be arranged to provide a multi-band solution. In multi-band arrangements, a first set of conductive elements forming a first antenna configured for a first frequency may be rotated (i.e., angularly offset) with respect to a second set of conductive elements forming a second antenna configured for a second frequency. Conversely, the first and second set of conductive elements may have the same angular configuration but different radii. In these multi-band configurations, additional pin diodes or other RF switching devices are provided to enable switching between the respective antenna elements. In an exemplary embodiment, the first antenna is configured to transmit/receive 5 GHz signals while the second antenna is configured to transmit/receive 2.4 GHz signals.

The common RF feed point may include a coaxial feed port that passes through the substrate and has a first coaxial part that is connected on a first side of the substrate to bottom layer conductive elements and a second coaxial part that is connected on a second side of the substrate to the top layer conductive elements. Also, the first and second coaxial parts of the coaxial feed port may be connected to respective conductive circles on respective sides of the substrate. In exemplary embodiments, the respective conductive circles have respective radii that act as a tuning parameter for impedance matching over single or multiple frequency bands.

BRIEF DESCRIPTION OF THE DRAWINGS

The foregoing and other beneficial features and advantages of the invention will become apparent from the following detailed description in connection with the attached figures, of which.

DETAILED DESCRIPTION OF ILLUSTRATIVE EMBODIMENTS

The present invention may be understood more readily by reference to the following detailed description taken in connection with the accompanying figures and examples, which form a part of this disclosure. It is to be understood that this invention is not limited to the specific products, methods, conditions or parameters described and/or shown herein, and that the terminology used herein is for the purpose of describing particular embodiments by way of example only and is not intended to be limiting of any claimed invention. Similarly, any description as to a possible mechanism or mode of action or reason for improvement is meant to be illustrative only, and the invention herein is not to be constrained by the correctness or incorrectness of any such suggested mechanism or mode of action or reason for improvement. Throughout this text, it is recognized that the descriptions refer both to methods and software for implementing such methods.

A detailed description of illustrative embodiments of the present invention will now be described with reference to FIGS. 1-11. Although this description provides a detailed example of possible implementations of the present invention, it should be noted that these details are intended to be exemplary and in no way delimit the scope of the invention.

Figure 1:
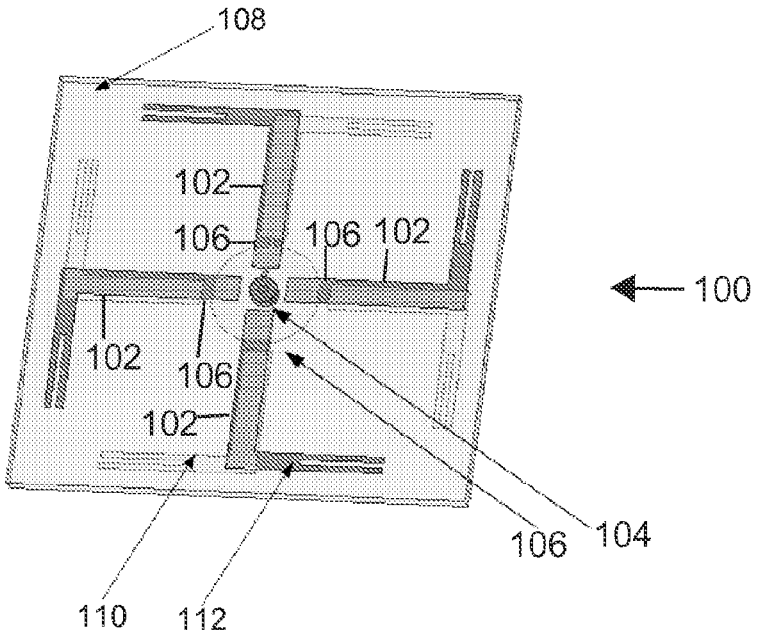
FIG. 1 illustrates an embodiment of an antenna layout having 8 gaps for placement of pin diodes.

FIG. 1 illustrates an embodiment of an antenna layout having 8 gaps for placement of pin diodes or other RF switching devices. The embodiment of FIG. 1 includes an antenna 100 composed of metallic elements 102 connected to a common RF feed point 104 by means of RF switches in the form of pin diodes 106, for example. Such a configuration of metallic elements 102 allows the generation of an omnidirectional radiation pattern in the azimuth plane when all the metallic elements 102 are connected directly to the RF feed point 104. To this end, each metallic element 102 is a wideband or multiband radiating element. The arrangement of these metallic elements 102 is such that the uniform current distribution on each of these elements (when all are directly connected to the RF feed point 104) generates an omnidirectional radiation pattern in the azimuth plane. The metallic elements 102 can be preferably placed symmetrically with respect to the center of the antenna 100 and at a relative distance which is less than one quarter of the wavelength in free space.

The arrangement of the metallic elements 102 is such that when at least one metallic element 102 is not connected to the RF feed point 104 (e.g., the RF switch 106 that connects the RF feed point 104 with the metallic element 102 is in the OFF state), the metallic element(s) 102 not connected to the RF feed point 104 acts as a reflector/director for the other elements and allows the generation of a directional radiation beam in one direction. On the other hand, the multiband/wideband behavior of the antenna 100 is obtained by using metallic elements 102 with multiband/wideband characteristics.

In the embodiment of FIG. 1, the antenna 100 includes eight folded metallic elements 102. The design is etched on respective sides a commercial circuit board substrate 108 and the coaxial RF feed port 104 is connected on the bottom layer 110 with ground, while the inner conductor is connected to the top layer 112. From the center feed lines on the top and bottom layers 112 and 110, respectively, four pairs of branches are designed to be 90 degrees to one another, and each of the pairs of branches can be connected/disconnected to the center feed 104 by means of pin diodes or other RF switching devices 106 as depicted in FIG. 1.

When all of the folded metallic elements 102 are connected to the central RF feed point 104 by means of RF switches 106, the radiating structure resembles an Alford loop antenna, which radiates an omnidirectional radiation pattern in in the plane of the antenna design (azimuth). On the other hand, directional modes are achieved by connecting just one pair of branches to the center feed 104, while the other three disconnected branches act as reflector elements.

In the embodiment of the invention depicted in FIG. 1, the design of the reconfigurable Alford antenna has a squared shape to generate and maximize the four directional modes while keeping the fundamental Alford loop behavior. In this embodiment, the four branches on the top and bottom layers are placed 90 degrees with respect to each other. This technique ensures uniform current distribution and an omnidirectional pattern when all of the four pairs are connected. On the other hand, when just one pair of branches is connected, the other three disconnected pairs of branches act as reflector elements pointing the beam toward the excited pair. Thus, each pair of branches has the dual capability to be used as an active element or as parasitic element. Also, each pair of branches can be activated (connected to the center feed 104) individually to generate a directional beam, while the connection of all of them to the center feed 104 allows the generation of an omnidirectional pattern. The branches that are disconnected from the center feed 104 act as parasitic (reflector) elements to enhance the directivity of each directional beam.

Figure 2:
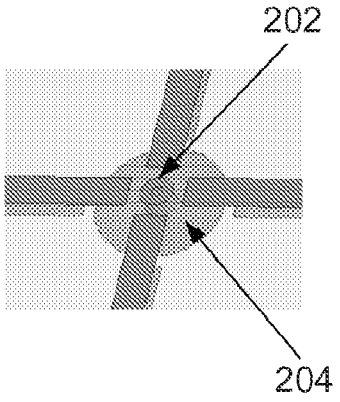
FIG. 2 illustrates a close-up view of the circular metallized tuning elements of the embodiment of FIG. 1.

As best illustrated in FIG. 2, the ratio between top layer circle 202 and bottom layer circle 204 that are connected to the feed line 104 in the embodiment of FIG. 1 determines the impedance matching of the antenna 100. The radii of these circles 202 and 204 act as a tuning parameter for impedance matching. For example, by varying the bottom layer radius, the antenna 100 can be optimized to improve the impedance matching over the single or multiple frequency bands.

Figure 3:
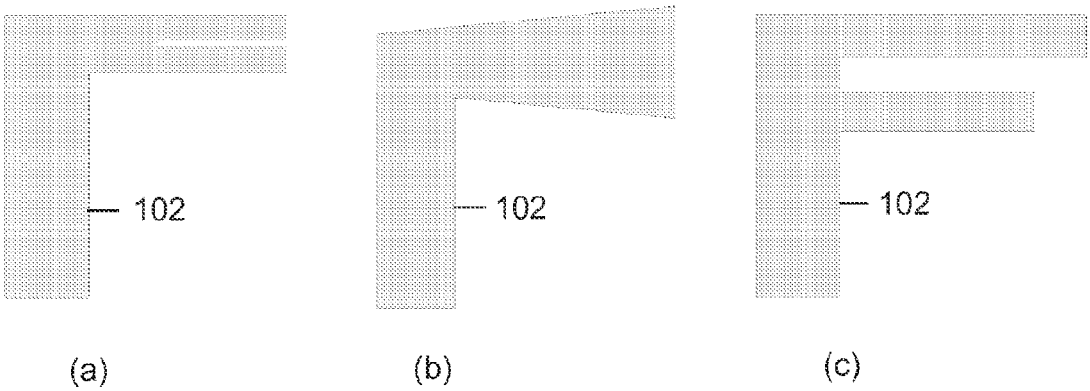
FIG. 3 illustrates examples of wing designs where (a) and (b) illustrate single wideband wing topologies while (c) illustrates a dual band wing topology.

In respective embodiments of the invention, the branches of antenna 100 can be realized to have a single wide frequency bandwidth or multiple resonant frequencies. If each pair of branches is designed to have a single slotted wing as shown in FIGS. 3(*a*) and 3(*b*), the antenna 100 can operate in a single wide bandwidth. On the other hand, if each pair of branches is designed so that the metallic element has a double wing structure shaped as an "F" as shown in FIG. 3(*c*), the antenna 100 would operate with a dual band behavior. Alternative designs of the wing are possible using defected or tapered structures to achieve the same purpose of wideband or multiband behavior. The fractional bandwidth (FBW) in a single or multiple resonance design can be adjusted by varying the width and length of the wing structure. As an example, sample prototypes using single slotted wings showed a FBW of about 30%.

Figure 4:
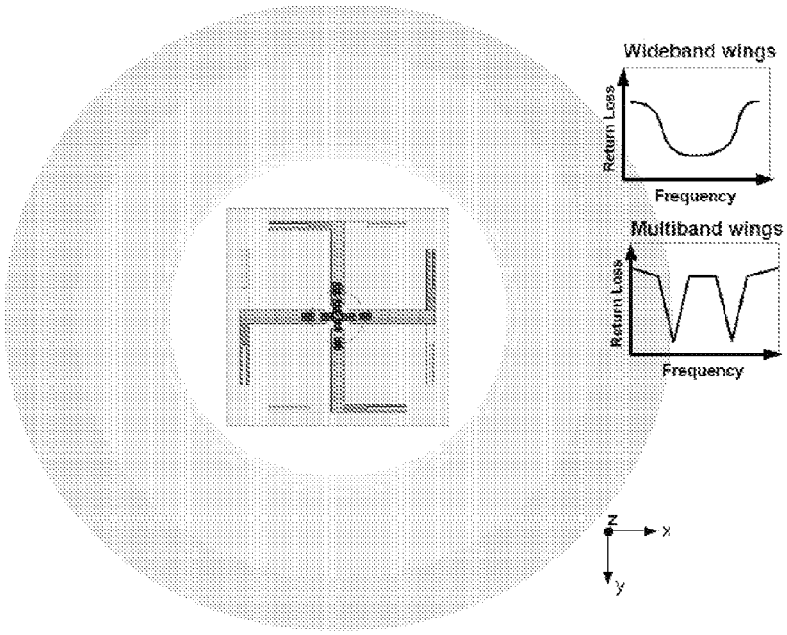
FIG. 4 illustrates the antenna of FIG. 1 in omnidirectional mode where all eight pin diodes are activated.

FIG. 4 illustrates the antenna 100 of FIG. 1 in omnidirectional mode where all eight pin diodes 106 are activated.

Figure 5:
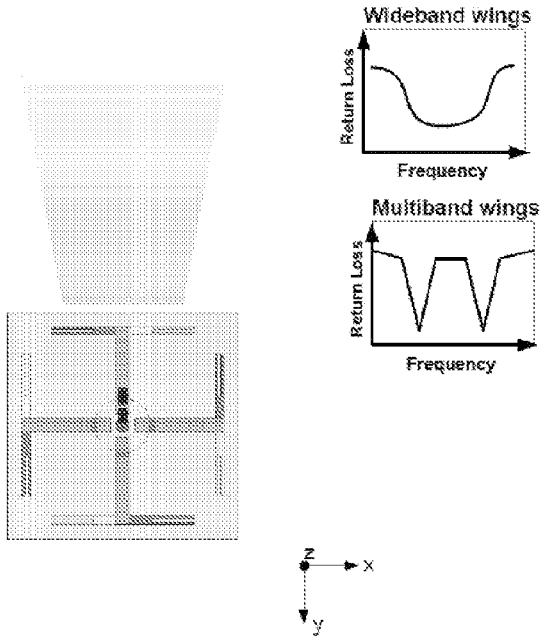
FIG. 5 illustrates the antenna of FIG. 1 in directional mode for a single pair of activated pin diodes.

FIG. 5 illustrates the antenna of FIG. 1 in directional mode for a single pair of activated pin diodes 106. As illustrated, the three disconnected branches act as reflector elements creating a directive beam. Four identical directional patterns may be generated by activating a single pair of branches at a time.

Figure 6:
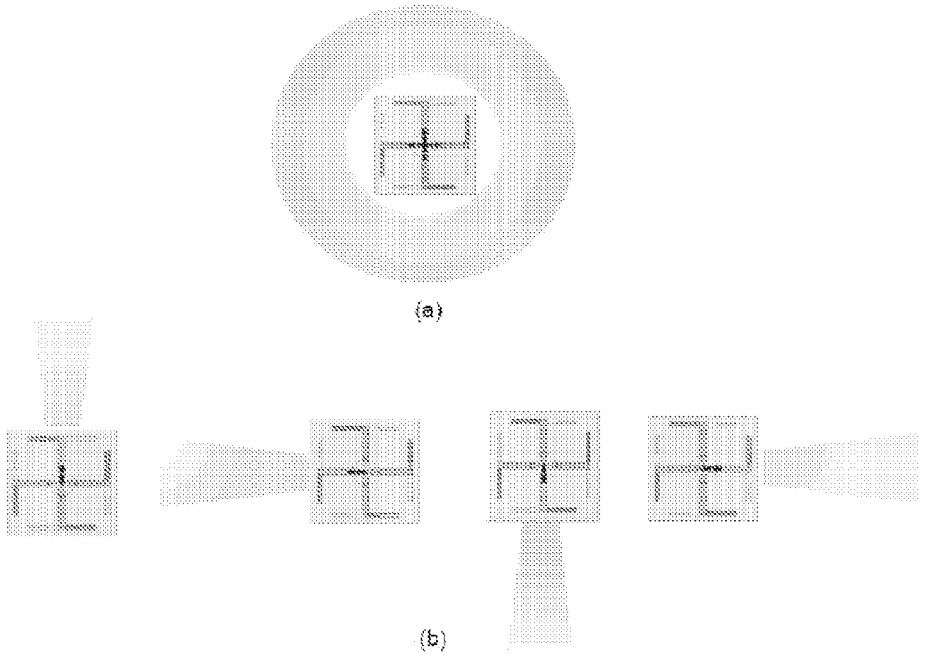
FIG. 6 illustrates a summary of the five possible radiation patterns of the antenna of FIG. 1 for omnimode (a) and four directional modes (b).
Figure 7:
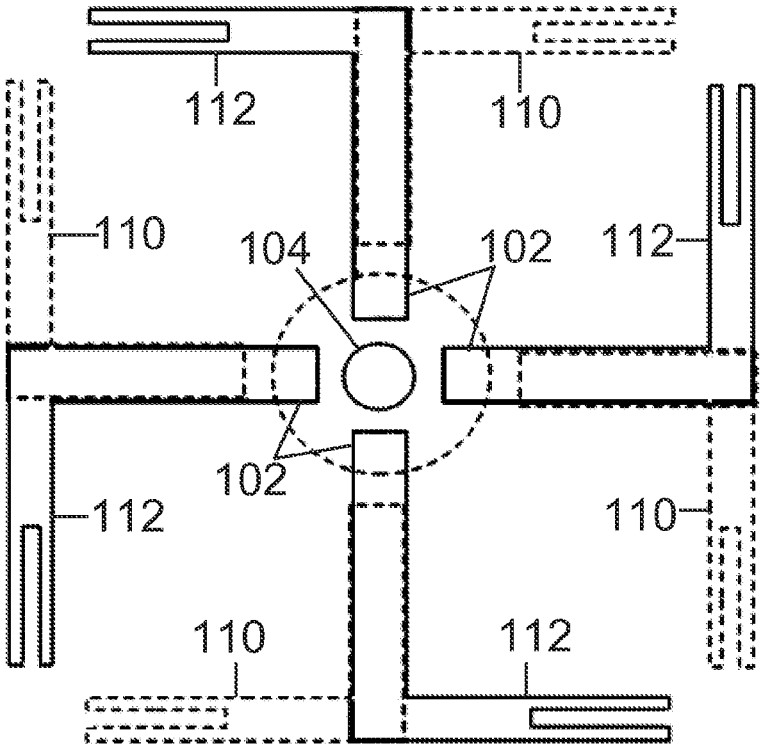
FIG. 7 illustrates a simplified view of the single band antenna design of FIG. 1.

FIG. 6 illustrates a summary of the five possible radiation patterns of the antenna of FIG. 1 for omnimode (a) and four directional modes (b).

A relevant feature of the antenna described herein is the possibility of generating reconfigurable patterns without the need of extra parasitic elements. Each pair of branches acts as a radiating element if connected to the center feed 104, and as a reflector (parasitic) when disconnected. The dual behavior of the microstrip branches provide the ability to generate omnidirectional and directional patterns without the need of extra parasitic elements and, in addition, avoids the need of complex matching networks just by tuning the radius of the top and bottom layer circles 202 and 204. This adjustment acts as a reactive effect that provides the optimal matching condition over the desired frequencies of operation.

The antenna 100 is also designed to operate by switching between four pairs of microstrip elements 102. The connection/disconnection to the feed port 104 of these elements 102 is provided by 8 pin diodes 106 (4 in top and 4 in bottom layer). Thus, each pair of branches can be connected/disconnected to the center feed port 104 by applying a proper forward voltage across the pin diodes 106. A total of just four low voltages (0 V in OFF state and 1 V in ON state) can be used to switch between the elements and generate omnidirectional or directional patterns.

Also, due to the compact design and the simple low power controllability, the antenna 100 can be implemented as a reconfigurable antenna in small wireless devices such as ZigBee modules and in general wireless sensors networks. In addition, the highly directive patterns reduce the interferences generated by employing many sensors, as opposed to the case where many sensors equipped with standard omnidirectional antennas are used.

Emerging networking devices incorporate many wireless standards into a single product. The antenna described herein can satisfy the demand of covering a single frequency band using the single band antenna design of FIG. 7, or the antenna of the invention may satisfy the demand for multiple frequency bands in order to provide connectivity for multiple wireless standards. For example, a multiband version of the antenna 100 may be used at 2.4 GHz and 5 GHz (802.11 standard) and/or at WiMAX frequencies as in the 802.16 family standard. Alternatively, using wideband wings, the antenna described herein can be employed in UWB devices to cover large bandwidths (greater or equal to 1 GHz).

Figure 8A:
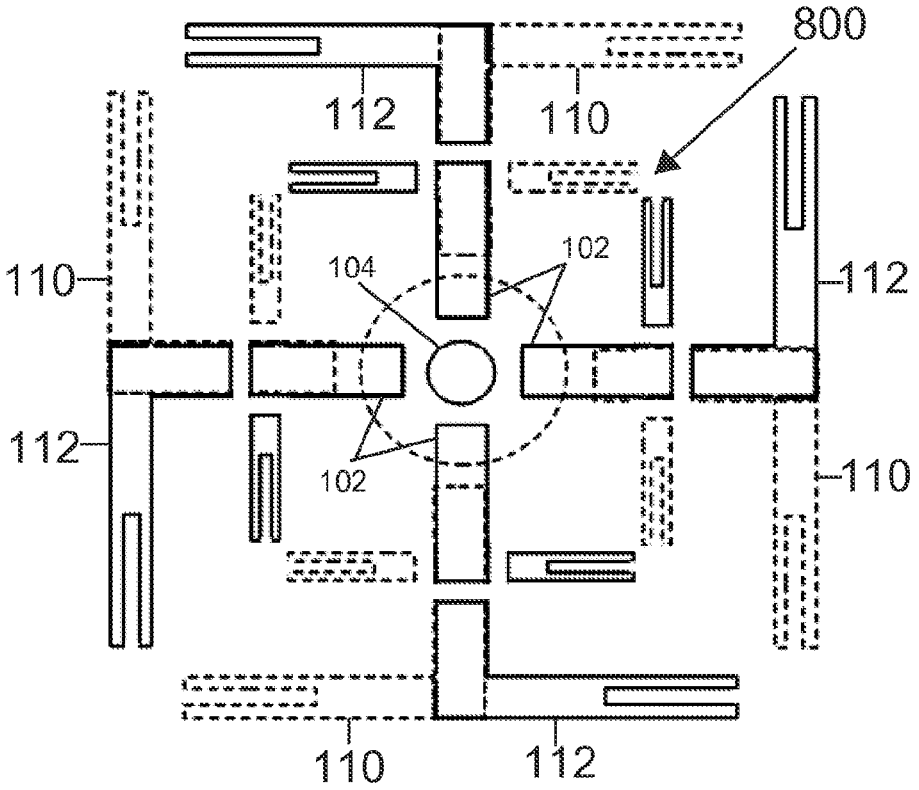
FIGS. 8*a* and 8*b* illustrate respective multiband antenna designs in accordance with the invention.
Figure 8B:
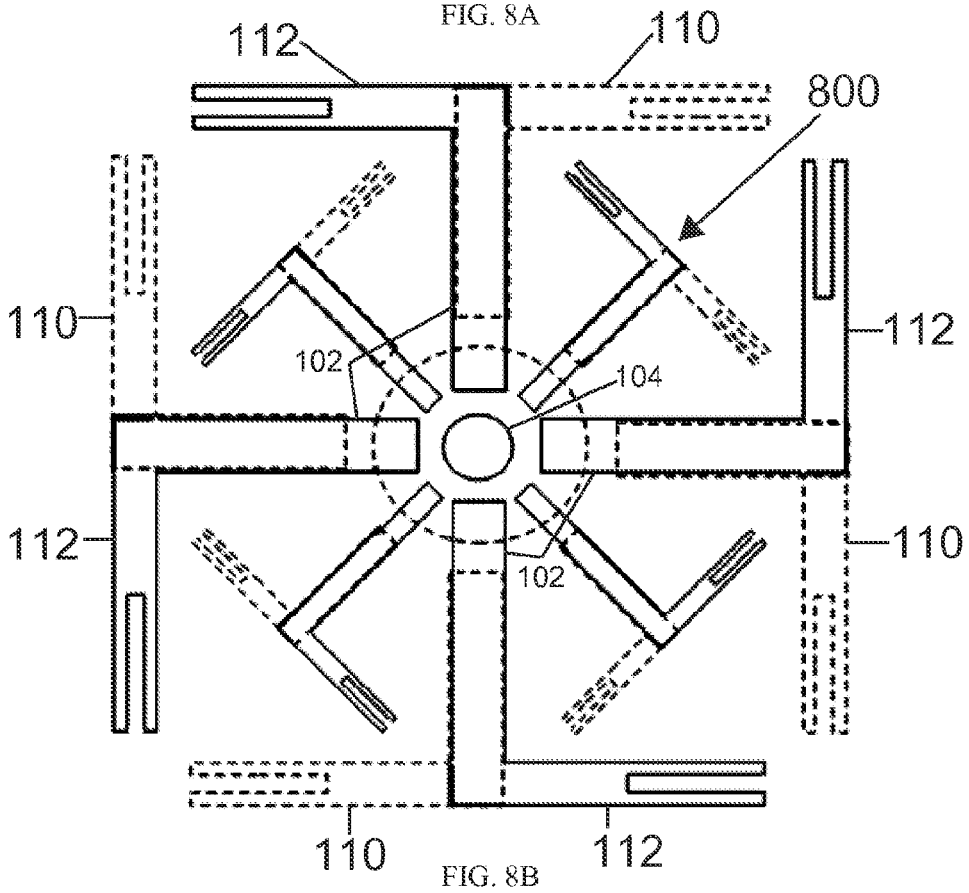

FIGS. 8*a* and 8*b* illustrate respective multiband antenna designs in accordance with the invention. As illustrated in FIG. 8*a*, each branch of the antenna may have two or more metallic elements 102 that are connected by RF switching elements (e.g., pin diodes, not shown) to enable the selection of antenna configurations having different radii and hence different frequency characteristics. On the other hand, as illustrated in FIG. 8*b*, a second antenna may be placed on the same substrate by rotating the branches of the second antenna with respect to the first antenna (e.g., 45°) so that the respective antenna branches do not touch. As with the embodiments of FIG. 7 and FIG. 8*a*, one set of 4 perpendicular antenna branches 112 is on top of the substrate 108 while a second set of 4 perpendicular antenna branches 110 is on the bottom of the substrate 108. In FIGS. 8*a* and 8*b*, the continuous line is the top layer 112, while the dashed line is the bottom layer 110. In the embodiments of FIGS. 8*a* and 8*b*, the respective antennas are selected to transmit/receive the desired frequencies, for example, 5 GHz and 2.4 GHz as used in the 802.11 standard. The gaps between the arms of the elements 102 are designed to mount the switching components 106, such as the PIN diodes illustrated in FIGS. 9*a* and 9*b*.

Figure 9B:
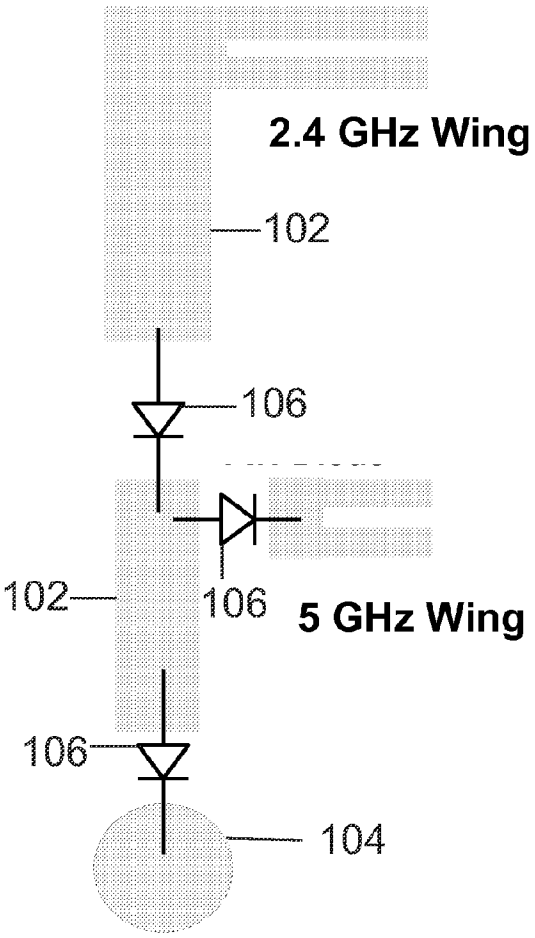
FIGS. 9*a* and 9*b* respectively illustrate multiple single-band elements and switchable multi-band elements in accordance with the invention.
Figure 9A:
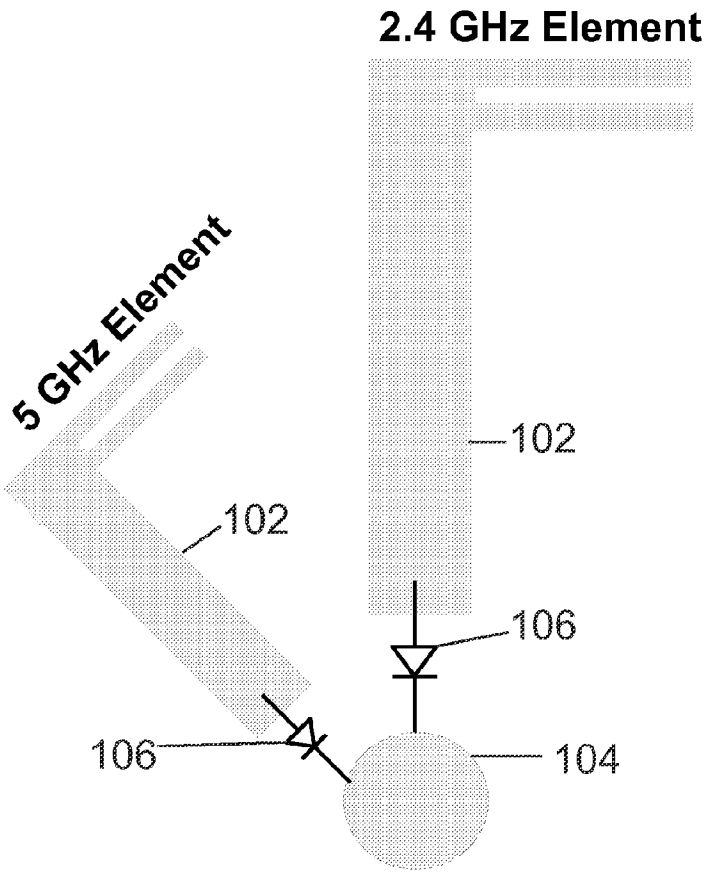

FIG. 9*a* illustrates how the respective elements 102 of the respective antenna branches may be connected to the RF feed port 104 by RF switching elements (e.g., pin diodes) 106 for the embodiments of FIGS. 8*a* and 8*b* for multiple single-band elements. FIG. 9*b* illustrates how switchable multi-band elements may be implemented in the embodiment of FIG. 8*a* in accordance with the invention. As illustrated in FIG. 9*b*, RF switches (pin diodes) 106 are placed between each conductive element to permit the elements to be selected.

The antennas of FIGS. 8*a* and 8*b* thus allow a corresponding device to operate in two frequency bands individually or simultaneously. This is important because the 802.11ac standard supports multiband for these two frequencies. The designs of FIGS. 8*a* and 8*b* allow the corresponding devices to communicate with two antennas in the route without requiring separate antenna and separate hardware.

Figure 11:
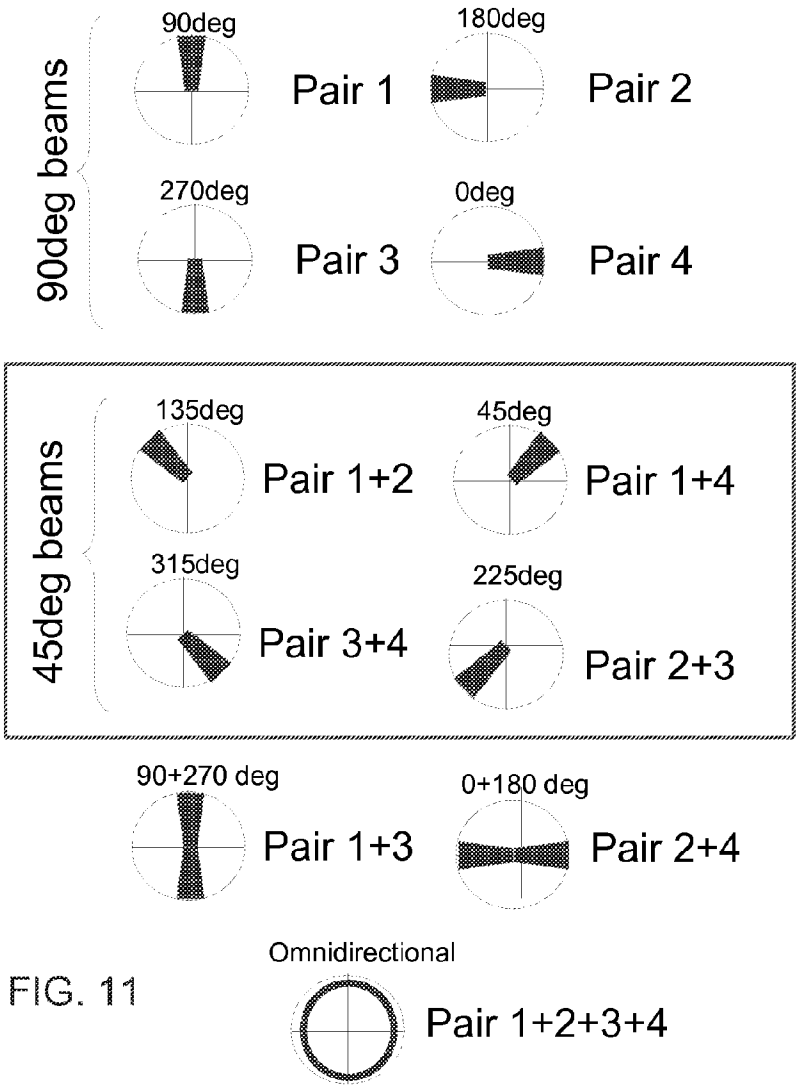
FIG. 11 illustrates possible radiation patterns generated by the antenna design of FIG. 10.
Figure 10:
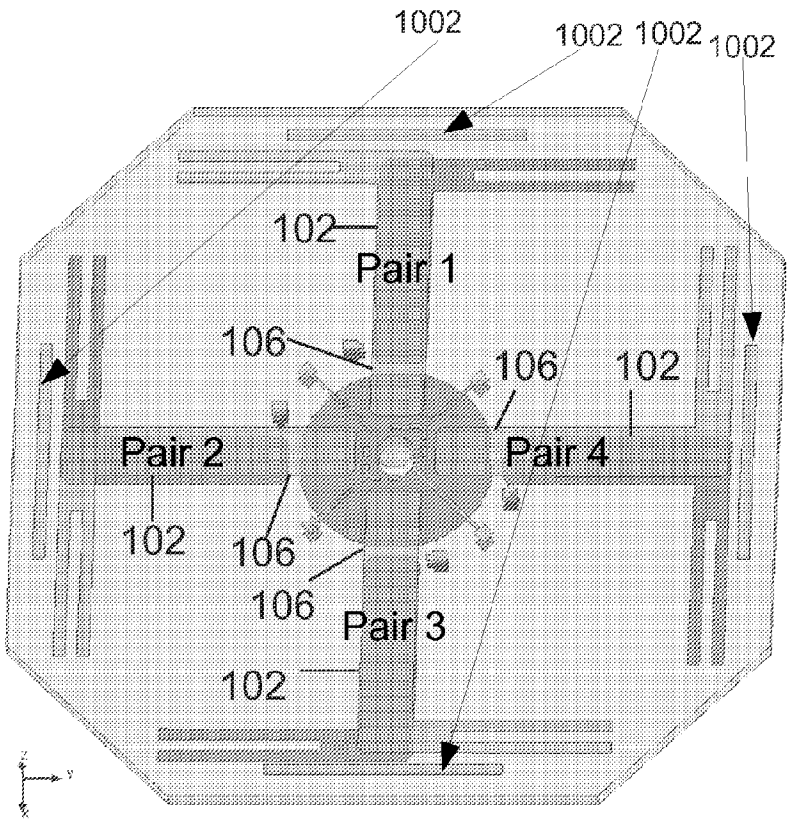
FIG. 10 illustrates a single band antenna design adapted to include microstrip parasitic elements in a further embodiment of the invention.

As noted above, the antennas described herein may be used to generate reconfigurable patterns without the need of extra parasitic elements. The planar antenna may or may not have additional parasitic elements placed on the top or bottom layer. These parasitic elements can be placed around the main 90° elements, acting as enhancement for beams directivity and gain. In essence, the parasitic elements act as director and/or reflectors during directional modes of operation, enhancing front-to-back ratio and gain of the radiation patterns. The, parasitic elements may be implemented to increase directivity and gain along 45° directions so as to generate more radiation patterns as illustrated in FIG. 11. FIG. 10 illustrates a single band antenna design adapted to include microstrip parasitic elements 1002 for such purposes. As illustrated in FIG. 11, integrating the parasitic antenna elements 1002 in this fashion supports 10 additional antenna patterns, which makes it easier for the router to establish a good connection while causing less interference. Those skilled in the art will appreciate that even when a omnidirectional beam is generated the gain is appreciably improved when such parasitic elements 1002 are used.

In mobile devices or vehicles, it is always fundamental to be able to provide a 360° coverage using, ideally, a small antenna. The antenna design described herein has potential applications to be incorporated into vehicles for terrestrial communications or in airplanes for air-to-air communications. It is relevant that a smart control of the antenna 100 can be implemented for security. For example, during in flight communications, it is important to guarantee a reliable connection with the flying aircraft. The employment of the antenna described herein can meet the demand of spreading (broadcasting) a signal to all the other aircraft covering 360° (using omnimode). To prevent interferences/intruders, the directional pattern also can focus the beam toward a single legitimate aircraft for communication.

The antenna described herein may also be used for femtocell applications. A femtocell is a small and low power cellular base station installed for small business or home purposes. Several studies pointed out the importance of having omnidirectional and directional radiation patterns to overcome interfering effects and to provide a stronger connectivity to the users. For this purpose, the antenna described herein can satisfy all these characteristics along with the advantage of being very compact and inexpensive.

Advantages

The main advantage of the antenna configuration described herein is that it allows the design of planar reconfigurable antennas capable of generating omnidirectional and directional radiation patterns over a wide frequency band or over multiple bands. As noted above, to the inventors' knowledge, the only antenna technology capable of omnidirectional and directional modes is the one described by M. Facco and D. Piazza, in "Reconfigurable Zero-Order Loop Antenna," IEEE International Symposium on Antennas and Propagation and USNC/URSI, 2012. However, the design described in that paper does not allow one to cover multiple or wide bands. By contrast, the antenna described herein can generate omnidirectional and directional patterns covering multiple or wide bandwidths.

Bandwidth Advantages:

The antenna configuration described herein also has many degrees of freedom in terms of generated bandwidth. In fact, by tuning the layout of the wings, the antenna 100 can resonate over a wide bandwidth or over multiple frequencies as depicted in FIGS. 4-6. The design of the branches can be developed in different fashions to support multiple or wide frequency bandwidth. For example, by adding multiple wing elements 102 as in the embodiments of FIGS. 8*a* and 8*b*, the antenna 100 is able to resonate over multiple frequencies. Alternatively, by designing the wings 102 with tapered or defected structures, the antenna 100 may operate over a wide bandwidth.

Size Advantages:

In designing reconfigurable antenna 100 described herein, a primary goal is to make the antenna suitable for the market by having smaller dimensions. In this regard, the antenna 100 described herein combines the benefits described above within a small area. The design is implemented over two layers of a standard PCB substrate and can be etched using commercial automated processes as used for circuit boards. The planar design also makes the antenna suitable for small form factor devices. In an exemplary embodiment, the overall design fits within a square of about $0.5\lambda \times 0.5\lambda$.

Cost Advantages:

Because of the small form factors and the ease of the manufacturing process, the total antenna cost is very low. By adding the price for the small PCB substrate 108, 8 pin diodes 106, and 8 inductors (for DC biasing), the total cost is extremely low compared to other reconfigurable antennas such as the Leaky Wave Antenna and Phased array or ESPAR antennas.

Insubstantial changes from the claimed subject matter as viewed by a person with ordinary skill in the art, now known or later devised, are expressly contemplated as being equivalently within the scope of the claims. For example, the branches need not be 90 degrees with respect to each other but may be disposed at other angles that permit the reflection of the directed beams. Also, those skilled in the art will appreciate that any diodes, transistors, etc. utilized in an exemplary embodiment may be replaced by corresponding optical elements. Therefore, obvious substitutions now or later known to one with ordinary skill in the art are defined to be within the scope of the defined elements.

What is claimed:

1. A planar reconfigurable antenna capable of generating omnidirectional and directional radiation patterns over a wide frequency band or over multiple frequency bands, comprising:

a substrate;

a plurality of conductive elements on respective sides of said substrate, wherein each of said conductive elements is a wideband or multiband radiating element;

a common RF feed point; and respective switches between said conductive elements and said RF feed point that selectively connect all of said conductive elements on said respective sides of said substrate to said common RF feed point for generation of an omnidirectional radiation pattern and that selectively connect pairs of less than all of said conductive elements on said respective sides of said substrate to said common RF feed point for generation of a directional radiation pattern, wherein conductive elements are configured such that conductive elements that are not connected to said common RF feed point act as a reflector for other conductive elements that are connected to said common RF feed point, and wherein said conductive elements are arranged on said substrate such that the contributions of radiation from each of said conductive elements when all of said conductive elements are directly connected to the common RF feed point form a radiation structure resembling an Alford loop antenna and sum up to generate said omnidirectional radiation pattern in an azimuth plane.

2. An antenna as in claim 1, wherein said conductive elements are disposed on opposite sides of said substrate in pairs.

3. An antenna as in claim 1, wherein the conductive elements are placed symmetrically on said substrate with respect to the common RF feed point at a center of the antenna and at a relative distance with respect to other conductive elements which is less than one quarter of a wavelength of the antenna in free space.

4. An antenna as in claim 2, wherein said plurality of conductive elements comprises four folded metallic elements on each side of said substrate, wherein pairs of said conductive elements on opposite sides of said substrate form four pairs of branches that are disposed 90 degrees with respect to each other.

5. An antenna as in claim 1, wherein said respective switches comprise pin diodes.

6. An antenna as in claim 1, wherein said common RF feed point comprises a coaxial feed port that passes through said substrate and has a first coaxial part that is connected on a first side of said substrate to conductive elements on said first side of said substrate and a second coaxial part that is connected on a second side of said substrate to conductive elements on said second side of said substrate.

7. An antenna as in claim 6, wherein said first and second coaxial parts of said coaxial feed port are connected to respective conductive circles on respective sides of said substrate.

8. An antenna as in claim 7, wherein said respective conductive circles have respective radii that act as a tuning parameter for impedance matching over single or multiple frequency bands.

9. An antenna as in claim 1, further comprising parasitic elements disposed with respect to said conductive elements so as to enhance directivity and gain of beams transmitted by the respective conductive elements in operation.

10. A planar reconfigurable antenna capable of generating omnidirectional and directional radiation patterns over a wide frequency band or over multiple frequency bands, comprising:

a substrate;

a plurality of conductive elements on respective sides of said substrate;

a common RF feed point; and respective switches between said conductive elements and said RF feed point that selectively connect all of said conductive elements on said respective sides of said substrate to said common RF feed point for generation of an omnidirectional radiation pattern and that selectively connect pairs of less than all of said conductive elements on said respective sides of said substrate to said common RF feed point for generation of a directional radiation pattern, wherein conductive elements are configured such that conductive elements that are not connected to said common RF feed point act as a reflector for other conductive elements that are connected to said common RF feed point, wherein each of said conductive elements is in the form of a wing having a first section that is connected to said common RF feed point and a second section that is substantially perpendicular to said first section, wherein said second section forms a double wing structure whereby said second section and said first section together form an "F" shape with two different electrical paths for high and low frequency bands.

11. An antenna as in claim 10, wherein said second section has a slot.

12. An antenna as in claim 10, wherein said second section forms multiple wing structures.

13. An antenna as in claim 10, wherein said second section is tapered.

14. A planar reconfigurable antenna capable of generating omnidirectional and directional radiation patterns over a wide frequency band or over multiple frequency bands, comprising:

a substrate;

a plurality of conductive elements on respective sides of said substrate;

a common RF feed point;

respective switches between said conductive elements and said RF feed point that selectively connect all of said conductive elements on said respective sides of said substrate to said common RF feed point for generation of an omnidirectional radiation pattern and that selectively connect pairs of less than all of said conductive elements on said respective sides of said substrate to said common RF feed point for generation of a directional radiation pattern, wherein conductive elements are configured such that conductive elements that are not connected to said common RF feed point act as a reflector for other conductive elements that are connected to said common RF feed point; and a second plurality of conductive elements on at least one side of said substrate and a second set of switches that selectively connect all of said second plurality of conductive elements to said common RF feed point for generation of an omnidirectional radiation pattern and that selectively connect less than all of said second plurality of conductive elements to said common RF feed point for generation of a directional radiation pattern at a second frequency different from the frequency of the radiation pattern generated by said conductive elements.

15. The antenna of claim 14, wherein the second plurality of conductive elements is rotated with respect to said conductive elements.

16. The antenna of claim 14, wherein the second plurality of conductive elements and the conductive elements have the same angular configuration with respect to said RF feed point but have different radii.

17. The antenna of claim 16, wherein the conductive elements and the second plurality of conductive elements are separated by a third set of switches for selectively activating the conductive elements and the second plurality of conductive elements.

18. The antenna of claim 14, wherein the frequency and the second frequency are 5 GHz and 2.4 GHz, respectively.

* * * * *